US009073723B1

(12) United States Patent
Pellegrin et al.

(10) Patent No.: US 9,073,723 B1
(45) Date of Patent: Jul. 7, 2015

(54) STACKER DEVICE FOR STACKING FLATS, A STORAGE DEVICE FOR STORING POSTAL FLATS, AND A POSTAL SORTING MACHINE

(71) Applicant: SOLYSTIC, Bagneux (FR)

(72) Inventors: Laurent Pellegrin, Livron sur Drome (FR); Christian Duclot, Annonay (FR); Wilfrid Beaugrand, Valence (FR)

(73) Assignee: SOLYSTIC, Bagneux (FR)

( * ) Notice: Subject to any disclaimer, the term of this patent is extended or adjusted under 35 U.S.C. 154(b) by 81 days.

(21) Appl. No.: 14/130,022

(22) PCT Filed: Sep. 5, 2013

(86) PCT No.: PCT/FR2013/052042

§ 371 (c)(1),
(2) Date: Dec. 30, 2013

(87) PCT Pub. No.: WO2014/044946

PCT Pub. Date: Mar. 27, 2014

(30) Foreign Application Priority Data

Sep. 19, 2012 (FR) ..... 12 58778

(51) Int. Cl.

| | |
|---|---|
| ***B65H 29/40*** | (2006.01) |
| ***B65H 31/06*** | (2006.01) |
| ***B65H 31/18*** | (2006.01) |

(52) U.S. Cl.

CPC ..... *B65H 29/40* (2013.01); *B65H 31/06* (2013.01); *B65H 31/18* (2013.01); *B65H 2301/321* (2013.01); *B65H 2301/4214* (2013.01); *B65H 2403/512* (2013.01); *B65H 2404/652* (2013.01); *B65H 2405/35* (2013.01); *B65H 2701/1916* (2013.01)

(58) Field of Classification Search

CPC ..... B65H 29/22; B65H 29/40; B65H 31/06; B65H 2301/4214; B65H 2701/1916

USPC ..... 271/177, 178

See application file for complete search history.

(56) References Cited

U.S. PATENT DOCUMENTS

| | | | | |
|---|---|---|---|---|
| 1,035,716 | A * | 8/1912 | Lynch et al. | 271/178 |
| 2,844,373 | A * | 7/1958 | Van Marle | 271/178 |
| 1,898,704 | A | 2/1993 | Winkler et al. | |

(Continued)

FOREIGN PATENT DOCUMENTS

| | | | |
|---|---|---|---|
| DE | 212 239 | A2 | 8/1984 |
| WO | 2012/084708 | A1 | 6/2012 |

*Primary Examiner* — David H Bollinger

(74) *Attorney, Agent, or Firm* — Ware, Fressola, Maguire & Barber LLP

(57) ABSTRACT

A stacker device (1) for stacking flats (100) on edge, which device includes a stacking support (2) that extends along a certain stacking axis (D2) for storing flats (100) on edge and in a stack, which flats are inserted successively onto said stacking support (2), a stacking actuator (4) for guiding each flat (100) to be stacked along an insertion axis (D1) transverse to the stacking axis (D2), and for inserting it at the back of said stack of flats (100), said stacking support (2) being mounted to move relative to the stacking actuator (4) along the stacking axis (D2), and said stacker device (1) including impulse means (9) synchronized with the stacking actuator (4) so as to move the stacking support (2) in translation by applying an impulse along the stacking axis (D2) when a flat (100) is inserted at the back of said stack of flats (100). A storage device and a postal sorting machine including such a stacker device (1).

11 Claims, 2 Drawing Sheets

(56) References Cited

U.S. PATENT DOCUMENTS

| | | | | |
|---|---|---|---|---|
| 5,372,360 | A * | 12/1994 | Ricciardi | 271/177 |
| 6,398,204 | B1 * | 6/2002 | Keane et al. | 271/2 |
| 7,845,484 | B2 * | 12/2010 | Zimmermann | 198/347.1 |
| 2004/0113354 | A1 * | 6/2004 | Leitz et al. | 271/177 |
| 2008/0121572 | A1 | 5/2008 | Zimmermann | |
| 2008/0230981 | A1 * | 9/2008 | Iwami et al. | 271/153 |
| 2014/0056682 | A1 * | 2/2014 | Hugues | 414/788.9 |

* cited by examiner

STACKER DEVICE FOR STACKING FLATS, A STORAGE DEVICE FOR STORING POSTAL FLATS, AND A POSTAL SORTING MACHINE

CROSS REFERENCE TO RELATED APPLICATIONS

This application is the U.S. National Stage of International Application Number PCT/FR2013/052042 filed on Sep. 5, 2013 and claims priority under 35 USC §119 to French Patent Application No. 1258778 filed on Sep. 19, 2013. Both applications are hereby incorporated by reference in their entirety.

TECHNICAL FIELD

The invention relates to the technical field of stacker devices for stacking postal flats. The invention relates more particularly to a stacker device for stacking flats on edge, which device includes a stacking support that extends along a certain stacking axis for storing flats on edge and in a stack, which flats are inserted successively onto the stacking support. The stacker device further includes a stacking actuator for guiding each flat to be stacked along an insertion axis transverse to the stacking axis, for inserting it at a first end of said stack of flats, and for pushing said first end of the stack while the flat is being inserted along the stacking axis. The stacker device further includes a retaining element that is mounted to move along the stacking axis and that is designed to retain the stack of flats at a second end of the stack that is opposite from said first end, while pushing the stack of flats towards the stacking actuator as the stack of flats is being formed. The invention relates even more particularly to a stacker device for stacking postal flats in a storage container equipping a sorting outlet of a postal sorting machine. Postal flats may be of various sizes, and they may also have a variety of mechanical characteristics, in particular as regards stiffness. Such a mailpiece may, inter alia, be an ordinary letter, a magazine, an envelope with or without a window, a newspaper, or indeed a catalog wrapped in plastic or in paper, with or without gussets. The invention also relates to a storage device for storing postal flats, and to a postal sorting machine.

PRIOR ART

In sorting outlet containers operating by stacking or by accumulation, the stacking actuator, which is of the type comprising a bucket wheel or a bladed wheel mounted to rotate on a stationary pin or axle, comes to press on the last flat in the stack (by brushing against it) in order to release space into which the current flat to be stacked can be inserted. The front of the stack is held by a retaining element that is mounted to move in translation along the stacking axis. That retaining element is pushed towards the stacking actuator against which the back of the stack bears, the retaining element being pushed by a spring, by a counterweight, or by any other suitable means. As the stack of flats is being formed on the stacking support or surface, the stack gathers weight, thereby requiring a stacking actuator that is powerful enough to press the stack of flats and to release space each time a new flat arrives, into which space the current flat can be inserted. The pressure exerted by said stacking actuator on the uncovered surface of the last flat in the stack tends to damage that flat irreversibly, e.g. by leaving marks, holes, or burns due to considerable friction. In addition, it would be too constraining and difficult technically, on each cycle, to adapt the speed, the power, and the position of the stacking actuator as a function of the loading from the stack.

Known stacker devices, such as those described, for example, in Publications WO 2012/084708 and U.S. Pat. No. 1,898,704 do not procure satisfactory solutions. Each of those devices includes a stacking actuator for stacking flats on a support. The support is mounted to move relative to the stacking actuator along a stacking axis in one direction only, in such a manner that inserting each flat into the stack is facilitated by the movement of the support.

SUMMARY OF THE INVENTION

An object of the invention is to remedy those drawbacks by proposing a stacker device that makes it easier to insert flats to be stacked, while also minimizing the risks of them being damaged, while keeping the stack of flats together, and while avoiding the need, for each cycle, to adapt the speed, the power, and the position of the stacking actuator as a function of the loading from the stack. Another object of the invention is to propose a storage device and a postal sorting machine that offer the same advantages.

To this end, the invention provides a stacker device for stacking flats on edge, which device includes:

- a stacking support that extends along a certain stacking axis for storing flats on edge and in a stack, which flats are inserted successively onto said stacking support;
- a stacking actuator designed for guiding each flat to be stacked along an insertion axis transverse to the stacking axis, for inserting it at a first end of said stack of flats, and for pushing said first end of the stack while the flat is being inserted along the stacking axis; and
- a retaining element that is mounted to move along the stacking axis and that is designed to retain the stack of flats at a second end of the stack that is opposite from said first end, while pushing the stack of flats towards the stacking actuator as the stack of flats is being formed;
- said stacker device being characterized in that said stacking support is mounted to move along the stacking axis in both directions, and in that said stacker device includes impulse means synchronized with the stacking actuator so as to move said stacking support by direct contact in the direction along said stacking axis that goes away from the stacking actuator, said impulse means including return means for bringing the stacking support back along the stacking axis towards the stacking actuator.

The basic idea of the invention is thus to apply impulses to the stacking support, the effect of which impulses is to overcome the inertia of the stack, thereby facilitating insertion of the current flat to be stacked, making it possible to limit the pressure that needs to be exerted by means of the stacking actuator on the stack of flats. Thus, the invention contributes to simplifying the stacking actuator and, in practice, to limiting the part it plays to guiding the flats while they are being stacked.

The stacker device of the invention may advantageously have the following features:

- the stacking actuator is a mechanical actuator mounted to rotate about a main axis embodied by a stationary pin in the stacker device, and the impulse means comprise a mechanical thrust actuator that is mounted to rotate about the main axis and that drives the stacking support by mechanical contact so as to move it in translation along the stacking axis;
- the stacking actuator and the thrust actuator are offset angularly relative to each other on the main axis so that each impulse precedes the arrival of each flat to be stacked at the back of the stack of flats. The predetermined angular offset between the stacking actuator and the thrust actuator advantageously makes it possible to adjust the sequence of actions of the guide and thrust mechanisms as a function, in particular, of the physical characteristics of the flats to be stacked;

the stacking actuator is a bucket wheel and the thrust actuator is provided with at least one eccentric zone;

the stacking support is mounted to move in translation on anti-friction means. The significant reduction in the friction of the stacking support advantageously makes it possible to reduce the forces to be generated by the impulse means and by the first return means, and to reduce the noise caused by the stacking support rubbing against its support;

the return means comprise at least one compression spring disposed beyond the stacking support relative to the stacking actuator;

the return means are constituted by a bendable element that is fastened under the stacking support and that is suitable for bending resiliently along said stacking axis;

the impulse means comprise resilient thrust means provided between the thrust actuator and the stacking support, designed to accumulate the force from each mechanical impulse and to deliver it to said stacking support at a later time. The resilient thrust means make it possible to deliver the force from the mechanical impulse while intensifying it.

The invention also provides a storage device for storing postal flats, which device includes a stacker device as defined above, and the invention also provides a postal sorting machine including a sorting conveyor for directing postal flats towards sorting outlets, each of which sorting outlets is equipped with such a storage device for storing flats.

BRIEF DESCRIPTION OF THE DRAWINGS

The present invention can be better understood and other advantages appear on reading the following detailed description of embodiments given by way of non-limiting example and with reference to the accompanying drawings, in which.

DESCRIPTION OF EMBODIMENTS

Figures 1, 2, 3:
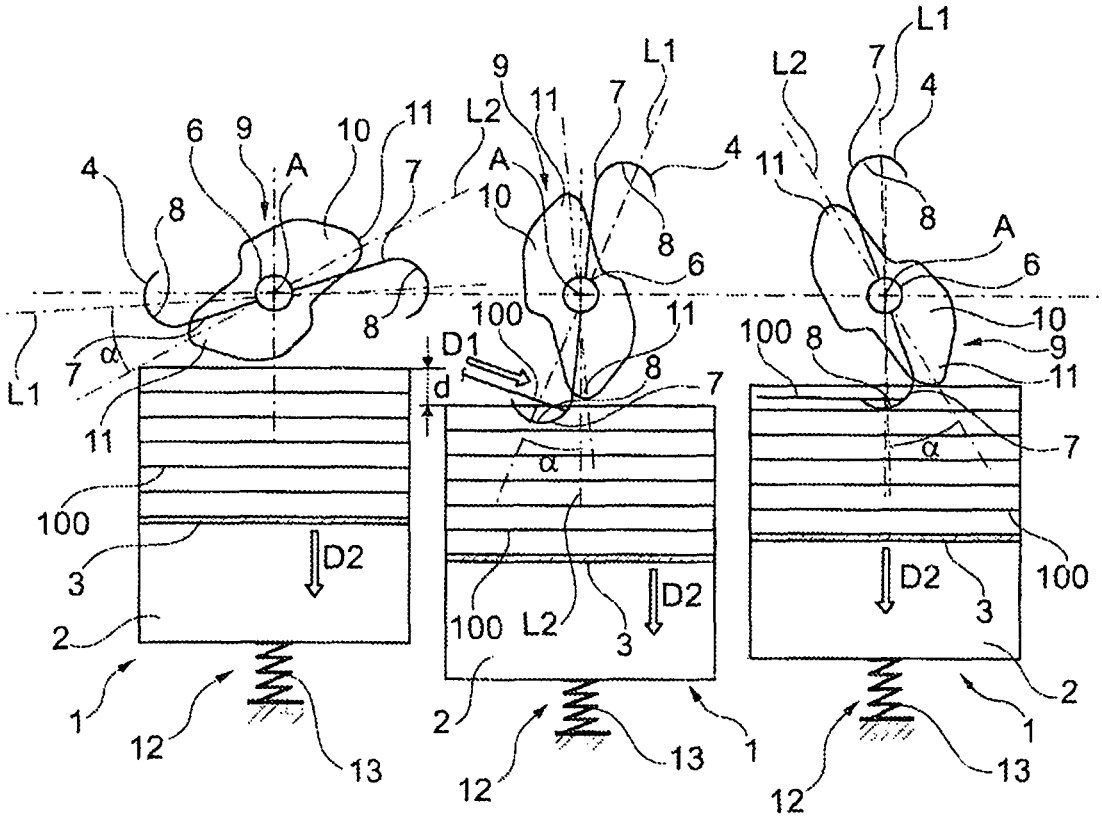
FIGS. 1 to 3 are diagrammatic fragmentary plan views of a first embodiment of the stacker device of the invention, shown in three different operating configurations.
Figure 4:
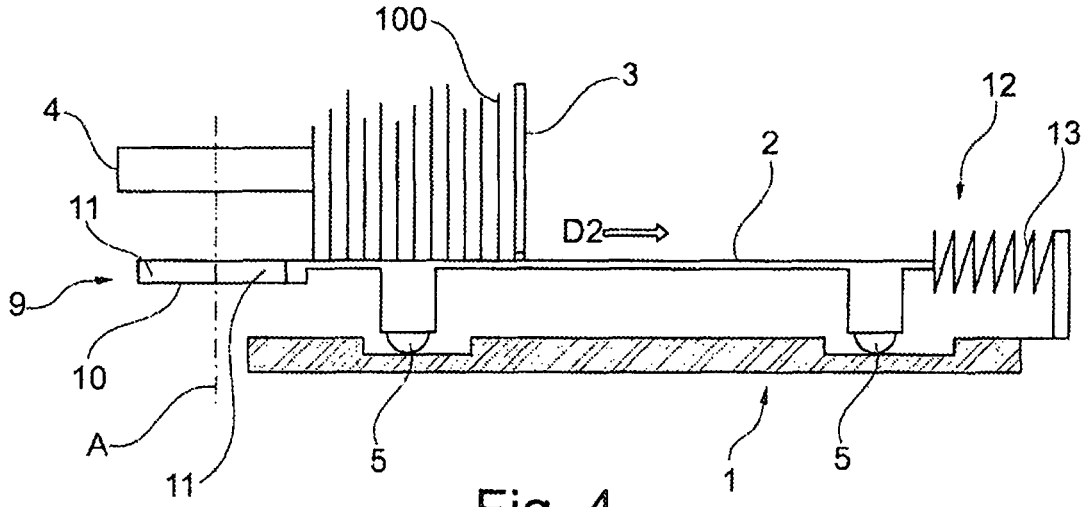
FIG. 4 is a diagrammatic fragmentary side view of the stacker device of FIGS. 1 to 3.

The stacker device of the invention is, in particular, designed to be incorporated into a storage device for a sorting outlet of a postal sorting machine.

In a first embodiment of the invention, and with reference to FIGS. 1 to 4, the stacker device 1 for postal flats 100 includes a stacking support 2 or stacking region forming a storage surface onto which each postal flat 100 is inserted on edge along a certain insertion axis D1 (shown in FIG. 2) and is stacked behind a stack of postal flats 100 on edge that is already formed on the stacking support 2. The postal flats 100 thus stack up one behind another along the stacking axis D2 on the stacking support 2, the insertion axis D1 being transverse to the stacking axis D2. The front of the stack of postal flats 100 on the stacking support 2 is retained by a retaining element that is in the form of a paddle 3 or plate that is mounted to move along the stacking axis D2, and that pushes the stack of postal flats 100 towards a stacking actuator 4 provided at one end of the stacking support 2, i.e. in a direction opposite from the stacking direction along the axis D2. The thrust force from the paddle 3 may be generated by a spring, a counterweight, or the like, not shown in the figures. The stacking support 2 is mounted to move in translation along the stacking axis D2 relative to the stacking actuator 4 between a first position shown in FIG. 1 and a second position shown in FIG. 2. The stacking support 2 may be guided in translation by any known and suitable means. For example, it may be mounted on wheels that are mounted to revolve freely, or on rollers that form anti-friction means 5, shown in FIG. 4, limiting the friction forces while the stacking support 2 is moving in translation.

In this example, the paddle 3 is substantially perpendicular to the stacking axis D2, i.e. to the stacking support 2. The paddle 3 is designed to move along the stacking axis D2 as the stack of postal flats 100 is being formed on the stacking support 2, i.e. as the thickness of the stack of postal flats 100 increases.

In the example shown, the stacking actuator 4 is a rotary mechanical actuator of the bucket wheel type that, in this example, is mounted to move in rotation about a main axis A that is substantially perpendicular to the stacking support 2 and to the stacking axis D2. The stacking actuator 4 has a hub 6 carried by a pin embodying the main axis A and from which, in this example, two bucket arms 7 extend, each of which is curved in the direction opposite to the direction in which a postal flat 100 to be stacked arrives. The inside zones of the bucket arms 7 define slots 8 suitable for finding themselves, in succession, in the path of the postal flat 100 to be stacked as the rotary actuator 4 rotates, and its slots 8 are designed to guide the front of each postal flat 100 to be stacked. Thus, as the stacking actuator 4 is rotating, the slot 8 takes hold of the postal flat 100 and guides it along the last postal flat 100 in the stack by moving with it until it is fully stacked. In addition, the bucket arm 7 comes to push the back of the stack strongly by brushing against the last postal flat 100 in the stack, and the current postal flat 100 is inserted once a first straight line L1 connecting the main axis A to the top of the bucket arm 7 is perpendicular to the stacking axis D2. The stacking actuator as described may be replaced with any equivalent stacking actuator.

In accordance with the invention, the stacker device 1 includes impulse means 9 that are synchronized with the stacking actuator 4 and that are designed to move the stacking support 2 in translation by applying impulses along the stacking axis D2 when a current postal flat 100 is stacked at the back of the stack. The impulse means 9 comprise a mechanical thrust actuator 10 mounted to rotate about the axis A. For example, it is possible to use a cam 10 (two cams in this example), mounted to rotate about the main axis A, the pin embodying said main axis A being motor-driven so as to drive both the stacking actuator 4 and the cam 10 in rotation. In the example shown, the cam 10 is provided with two eccentric zones 11 that are diametrically opposite each other and that are designed to drive the stacking support 2 by direct contact, so as to move it in translation between the first position and the second position. The cam 10 is offset angularly from the stacking actuator 4 so that a second straight line L2 connecting the main axis A to the tops of the eccentric zones 11 is angularly offset relative to the first straight line L1, about the main axis A, by an impulse angle α. The cam 10 is therefore advanced relative to the bucket arm 7. Thus, as described below, the impulse generated by the cam 10 is slightly earlier than the arrival of the postal flat 100 to be stacked and the application of maximum pressure by the bucket arm 7 on the stack. The inertia from the stack is thus overcome by the impulse caused by the cam 10, thereby relieving the bucket arm 7 correspondingly. The stacker device 1 further includes at least one abutment (not shown) designed to prevent the stacking support 2 from moving, in particular for limiting the extent to which the stacking support 2 can move in the event of a small amount of loading from stacked postal flats 100. The impulse angle α may, in particular, lie in the range 30° to 60° and preferably in the range 40° to 50°. Provision may be made for the impulse angle α to be mechanically adjustable as selected by the operator. Similarly, the cam 10 may be mounted removably so as to be changed in order to adapt the stroke of the stacking support 2 on application of the impulse.

In a variant embodiment that is not shown, the stacking actuator may be provided with a single arm only, in which case the mechanical thrust actuator is provided with a single eccentric zone. Thus, the impulse means enable the stacking support to change positions once per full rotation of the eccentric zone about the main axis.

The impulse means 9 further include return means 12 that act to oppose movement of the stacking support 2 from the first position towards the second position in order to bring it back to the first position. The return means 12 may be constituted by a compression spring 13 that is already pre-stressed before each impulse. Thus, the compression spring 13 is compressed to a greater extent while the stacking support 2 is moving from the first position to the second position under the action of the cam 10 and, by means of the effect of it relaxing, thrusts the stacking support 2 from the second position towards the first position when the cam 10 no longer thrusts the stacking support 2. Naturally, the thrust force from the compression spring 13 is less than the thrust force from the cam 10.

Operation of the stacker device 1 is described below. With reference to FIG. 1, before a postal flat 100 to be stacked arrives, the stacking support 2 is in the first position. The cam 10 is not driving the stacking support 2 and the compression spring 13 is pre-stressed to some extent. The bucket arm 7 is in an intermediate position in which it is not in the path of the postal flat 100 to be stacked.

Before a postal flat 100 to be stacked arrives, the bucket arm 7 and the cam 10 are actuated so that they move in rotation about the main axis A to the position shown in FIG. 2, in which the first straight line L1 is inclined relative to the stacking axis D2, enabling the cam 10 to move the stacking support 2 while also enabling the bucket arm 7 to keep the stack together. In this position, the slot 8 is in alignment with the path of the postal flat 100 to be stacked that is arriving. The stacking actuator 4 therefore receives a postal flat 100 and continues to rotate about the main axis A together with the cam 10. As shown in FIG. 3, the cam 10 then loses its thrust action for moving the stacking support 2 in translation, and the stacking support 2 is thus moved towards the stacking actuator 4 by the compression spring 13, in the direction opposite from the stacking direction along the axis D2. At the same time, the stacking actuator rotating 4 enables the postal flat 100 received in its slot 8 to be guided and to be stacked by allowing it to slide from its bucket arm 7.

Between the first and second positions, the stacking support 2 is moved by an impulse distance d shown in FIGS. 1 and 2. The amplitude of this impulse distance d depends on the dimensions of the cam 10. Due to the fact that the cam 10 is actually made up of two cams, each time it rotates through one full turn about the main axis A, its two eccentric zones 11 enable the position change between the first position and the second position to be made twice.

The steps described with reference to FIGS. 1, 2, and 3 are repeated after the cam 10 and the bucket arm 7 have rotated through one half-turn for each new postal flat 100 to be stacked.

In a variant embodiment (not shown), the return means may include or comprise a traction spring provided between the stacking support and the main axis. The traction spring may replace or be combined with the above-described compression spring.

Figures 5, 6, 7:
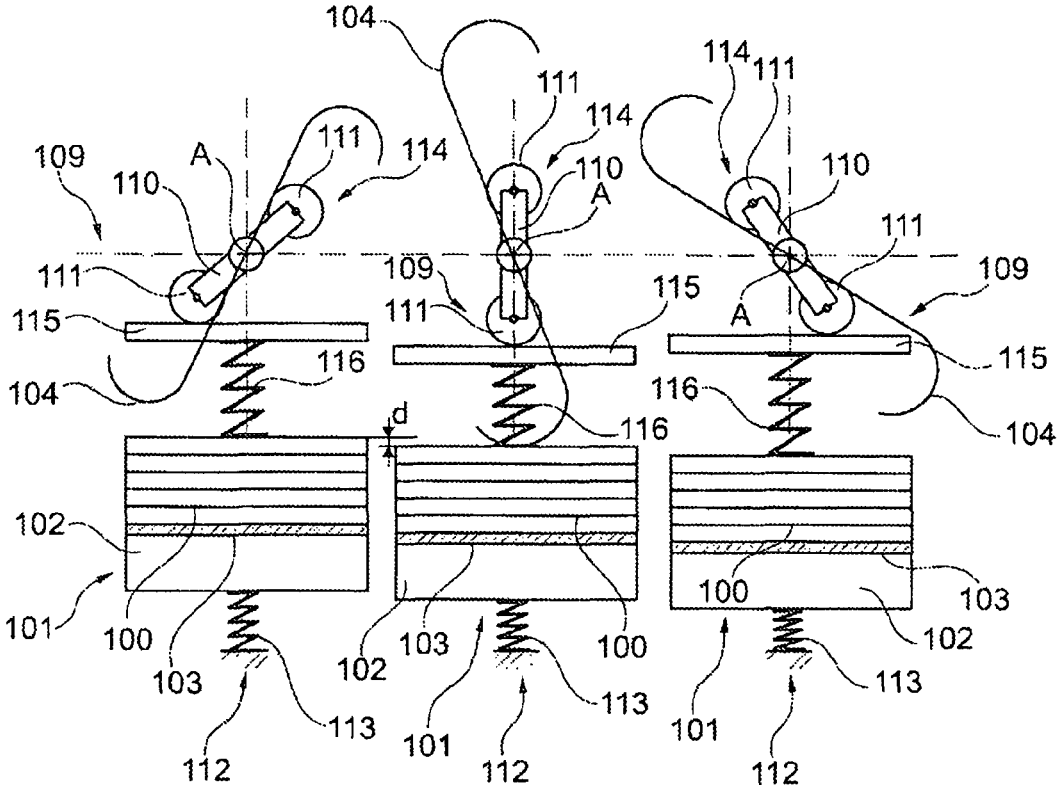
FIGS. 5 to 7 are diagrammatic fragmentary plan views similar to FIGS. 1 to 3 of a second embodiment of a stacker device of the invention. In these figures, the elements analogous to the elements shown in FIGS. 1 to 4 are given the same reference numerals, plus 100.

FIGS. 5 to 7 show a second embodiment of the stacker device 101 of the invention, only the differences relative to the first embodiment being described below. In this second embodiment, the impulse means 109 include a mechanical thrust actuator 110 in the form of an actuator arm 110 that is carried in its mid-portion by a the pin embodying the main axis A secured to the stacking actuator 104, and that has an eccentric zone 111 provided with an idler roller 114 at each of its ends. The actuator arm 110 operates in a manner similar to the above-mentioned cam 10. The stacker device 101 further includes return means 112 similar to the return means 12 of the preceding embodiment. In addition, the stacker device 101 includes resilient thrust means 116 provided between the actuator arm 110 and the stacking support 102, which means are designed to accumulate the mechanical impulse force generated by the actuator arm 110 and to deliver it at a later time to the stacking support 102 while intensifying it along the stacking axis D2. In the example shown, the resilient thrust means include a compression spring 116 separated from the actuator arm 110 by a thrust plate 115 that is substantially parallel to the retaining element 103. Thus, the stacking support 102 is driven in indirect manner by the actuator arm 110 via the thrust plate 115 and via the compression spring 113. Operation of the stacker device 101 is substantially the same as operation of the preceding embodiment, except for the resilient thrust means 116. In this second embodiment, the amplitude of the impulse distance d depends on the dimensions of the actuator arm 110, on its speed of rotation, on the characteristics of the compression spring 116, and on the combined weight of the stacking support 102 and of the stack of postal flats 100.

Figure 8:
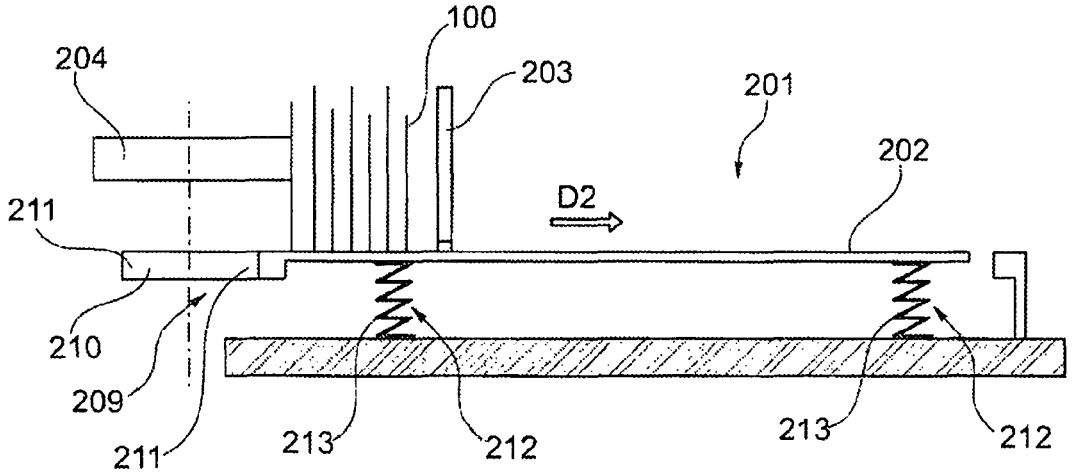
FIG. 8 is a diagrammatic fragmentary side view of a third embodiment of the stacker device of the invention. In this figure, the technical elements analogous to the technical elements shown in FIG. 4 are given the same reference numerals, plus 200.

FIG. 8 shows a third embodiment of the stacker device 201 of the invention including a stacking actuator 204 and a stacking support 202, only the differences relative to the first embodiment being described below. In this third embodiment, the stacking support 202 includes return means 212 made up of bendable elements, which, in this example, are compression springs 213 that are disposed under the stacking support 2 and that are suitable for bending so as to allow the stacking support 202 to move from its first position to its second position and for returning it to its first position after the impulse. The number and the locations of the compression springs 213 are adapted as a function, in particular, of the weight of the stack to be supported. The compression springs 213 may also be replaced with elements of the silent block type or with any suitable element.

In an embodiment that is not shown, the first and third embodiments may be combined. Thus, a cam may be used indirectly and an actuator arm may be used directly. In a variant embodiment of the invention that is not shown in the figures, a letter-bottom abutment situated at the end of the stacking support that is close to the stacking actuator prevents the postal flats from moving backwards on the stacking support while it is returning from the second position to the first position. In other variant embodiments of the invention that are not shown, the stacking support may further include a crenellated surface making it possible to retain the edges of the postal flats on edge, or a belt made of a material of the adhesive type, so as to prevent the postal flats from slipping over its surface.

The invention makes it possible to achieve the above-mentioned objectives. The stacker device 1; 101; 201 of the invention makes it possible to generate mechanical impulses that are applied to the stacking support 2; 102; 202 so as to overcome the inertia of the stack of postal flats 100 and thus so as to improve the effectiveness and the quality of the stacking of the postal flats 100, regardless of their nature and of the quantity already stacked. The invention also makes it possible to avoid having to over-dimension the stacking actuator 4, 104, 204 and to limit the risk of damaging the postal flats 100, of jamming, or of improper stacking. The stacker device 1; 101; 201 may be incorporated into a storage device and into a conventional postal sorting machine. Naturally, the present invention is in no way limited to the above description of one of its embodiments, which can undergo modifications without going beyond the ambit of the invention.

What is claimed is:

1. A stacker device for stacking flats on edge, which device comprises:

a stacking support that extends along a certain stacking axis for storing flats on edge and in a stack, which flats are inserted successively onto said stacking support;

a stacking actuator designed for guiding each flat to be stacked along an insertion axis transverse to the stacking axis, for inserting it at a first end of said stack of flats, and for pushing said first end of the stack while the flat is being inserted along the stacking axis; and a retaining element that is mounted to move along the stacking axis and that is designed to retain the stack of flats at a second end of the stack that is opposite from said first end, while pushing the stack of flats towards the stacking actuator as the stack of flats is being formed;

said stacker device being characterized in that said stacking support is mounted to move along the stacking axis in both directions, and in that said stacker device includes impulse means synchronized with the stacking actuator so as to move said stacking support by direct contact in the direction along said stacking axis that goes away from the stacking actuator, said impulse means including return means for bringing the stacking support back along the stacking axis towards the stacking actuator.

2. The stacker device according to claim 1, characterized in that the stacking actuator is a mechanical actuator mounted to rotate about a main axis embodied by a stationary pin in the stacker device, and in that said impulse means comprise a mechanical thrust actuator that is mounted to rotate about said main axis and that drives said stacking support by mechanical contact so as to move it in translation along the stacking axis.

3. The stacker device according to claim 2, characterized in that said stacking actuator and said thrust actuator are offset angularly relative to each other on said main axis so that each impulse precedes the arrival of each flat to be stacked at the back of said stack of flats.

4. The stacker device according to claim 3, characterized in that said stacking actuator is a bucket wheel and said thrust actuator is provided with at least one eccentric zone.

5. The stacker device according to claim 2, characterized in that said stacking actuator is a bucket wheel and said thrust actuator is provided with at least one eccentric zone.

6. The stacker device (1) according to claim 1, characterized in that the stacking support (2) is mounted to move in translation on anti-friction means (5).

7. The stacker device according to claim 1, characterized in that said return means comprise at least one compression spring disposed beyond said stacking support relative to said stacking actuator.

8. The stacker device according to claim 1, characterized in that said return means are constituted by a bendable element that is fastened under said stacking support and that is suitable for bending resiliently along said stacking axis.

9. The stacker device according to claim 1, characterized in that said impulse means comprise resilient thrust means provided between the thrust actuator and the stacking support, designed to accumulate the force from each mechanical impulse and to deliver it to said stacking support at a later time.

10. The storage device for storing postal flats, characterized in that it includes a stacker device according to claim 1.

11. A postal sorting machine including a sorting conveyor for directing postal flats towards sorting outlets, said postal sorting machine being characterized in that each sorting outlet is equipped with a storage device according to claim 10.

* * * * *